US010794630B2

(12) United States Patent
Cavagne et al.

(10) Patent No.: US 10,794,630 B2
(45) Date of Patent: Oct. 6, 2020

(54) METHOD AND DEVICE FOR SEPARATING AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Patrice Cavagne, Le Perreux (FR); Benedicte Dos Santos, Annet sur Marne (FR); Yann-Pierrick Lemaire, Antony (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 16/054,223

(22) Filed: Aug. 3, 2018

(65) Prior Publication Data

US 2019/0041130 A1 Feb. 7, 2019

(30) Foreign Application Priority Data

| | | |
|---|---|---|
| Aug. 3, 2017 | (FR) | 17 57493 |
| Aug. 3, 2017 | (FR) | 17 57495 |
| Aug. 3, 2017 | (FR) | 17 57497 |
| Aug. 3, 2017 | (FR) | 17 57498 |

(51) Int. Cl.
*F25J 3/04* (2006.01)
*F25J 3/02* (2006.01)

(52) U.S. Cl.
CPC ..... *F25J 3/04818* (2013.01); *F25J 3/0295* (2013.01); *F25J 3/0406* (2013.01); (Continued)

(58) Field of Classification Search
CPC .... F25J 3/04818; F25J 3/0295; F25J 3/04012; F25J 3/04024; F25J 3/0406; F25J 3/04406; F25J 3/04775; F25J 3/04381; F25J 3/04375; F25J 3/04393; F25J 3/04812; F25J 2280/10; F25J 2230/22; F25J 2215/40
See application file for complete search history.

(56) References Cited

U.S. PATENT DOCUMENTS

| | | |
|---|---|---|
| 2,113,680 A | 4/1938 | De Baufre |
| 2,664,718 A | 1/1954 | Rice |

(Continued)

FOREIGN PATENT DOCUMENTS

| | | |
|---|---|---|
| CN | 201 173 660 | 12/2008 |
| DE | 102 09 421 | 4/2003 |

(Continued)

OTHER PUBLICATIONS

French Search Report and Written Opinion for FR 1 757 497, dated Mar. 19, 2018.

(Continued)

*Primary Examiner* — Brian M King
(74) *Attorney, Agent, or Firm* — Justin K. Murray

(57) ABSTRACT

Method for separating air by cryogenic distillation, wherein air is compressed in a compressor and is subsequently sent to a heat exchanger, with the air cooled in the exchanger being sent to a check valve downstream of the heat exchanger and subsequently to a turbine, the valve being positioned so that air from a short-circuiting duct cannot return to the exchanger from the compressor.

20 Claims, 1 Drawing Sheet

(52) U.S. Cl.
CPC ..... *F25J 3/04012* (2013.01); *F25J 3/0423* (2013.01); *F25J 3/04024* (2013.01); *F25J 3/04066* (2013.01); *F25J 3/0486* (2013.01); *F25J 3/04109* (2013.01); *F25J 3/04127* (2013.01); *F25J 3/04187* (2013.01); *F25J 3/04193* (2013.01); *F25J 3/04254* (2013.01); *F25J 3/04296* (2013.01); *F25J 3/04381* (2013.01); *F25J 3/04393* (2013.01); *F25J 3/04406* (2013.01); *F25J 3/04412* (2013.01); *F25J 3/04775* (2013.01); *F25J 3/04787* (2013.01); *F25J 3/04812* (2013.01); *F25J 3/04824* (2013.01); *F25J 3/04866* (2013.01); *F25J 3/04896* (2013.01); *F25J 2200/04* (2013.01); *F25J 2215/42* (2013.01); *F25J 2215/50* (2013.01); *F25J 2230/22* (2013.01); *F25J 2230/40* (2013.01); *F25J 2240/04* (2013.01); *F25J 2240/10* (2013.01); *F25J 2240/42* (2013.01); *F25J 2245/40* (2013.01); *F25J 2280/10* (2013.01); *F25J 2280/20* (2013.01); *F25J 2290/12* (2013.01)

(56) References Cited

U.S. PATENT DOCUMENTS

| | | | | |
|---|---|---|---|---|
| 5,596,885 | A * | 1/1997 | Grenier | F25J 3/04018 62/646 |
| 2004/0050095 | A1 | 3/2004 | Brigham et al. | |
| 2004/0221612 | A1 * | 11/2004 | Jaouani | F25J 3/04054 62/656 |
| 2008/0223076 | A1 | 9/2008 | Le Bot | |
| 2009/0241595 | A1 * | 10/2009 | Chinta | F25J 3/04024 62/644 |
| 2012/0047943 | A1 * | 3/2012 | Barclay | C10L 3/10 62/613 |
| 2012/0118006 | A1 * | 5/2012 | Judas | F25J 3/04054 62/606 |

FOREIGN PATENT DOCUMENTS

| | | |
|---|---|---|
| DE | 10 2006 027650 | 2/2007 |
| DE | 10 2011 121314 | 6/2013 |
| DE | 10 2013 002094 | 8/2014 |
| EP | 0 611 936 | 8/1994 |
| EP | 0 644 388 | 3/1995 |
| EP | 1 014 020 | 6/2000 |
| EP | 1 055 894 | 11/2000 |
| EP | 1 711 765 | 4/2005 |
| EP | 1 782 011 | 1/2006 |
| EP | 2 458 311 | 5/2012 |
| EP | 2 482 016 | 8/2012 |
| EP | 2 489 968 | 8/2012 |
| EP | 2 600 090 | 6/2013 |
| EP | 2 831 525 | 10/2013 |
| EP | 2 963 369 | 1/2016 |
| EP | 2 963 370 | 1/2016 |
| FR | 2 721 383 | 12/1995 |
| FR | 2 851 330 | 8/2004 |
| FR | 2 861 841 | 5/2005 |
| FR | 2 895 068 | 6/2007 |
| FR | 2 913 670 | 9/2008 |
| FR | 2 913 759 | 9/2008 |
| FR | 2 943 408 | 9/2010 |
| FR | 2 985 305 | 7/2013 |
| FR | 3 010 778 | 3/2015 |
| FR | 3 033 397 | 9/2016 |
| GB | 1 500 610 | 2/1978 |
| JP | S54 162 678 | 12/1979 |
| JP | 2005 221 199 | 8/2005 |
| JP | 2015 114 083 | 6/2015 |
| WO | WO 2005/064252 | 7/2005 |
| WO | WO 2006/005745 | 1/2006 |
| WO | WO 2013/148799 | 10/2013 |
| WO | WO 2015/082860 | 6/2015 |

OTHER PUBLICATIONS

French Search Report and Written Opinion for FR 1 757 493, dated Mar. 19, 2018.
French Search Report and Written Opinion for FR 1 757 495, dated Mar. 20, 2018.
French Search Report and Written Opinion for FR 1 757 498, dated Mar. 1, 2018.
MacConnell, "Process Control and Optimization," Separation Controls, Air Instrument Engineers Handbook, vol. II, Chapter 8.37, Jan. 1, 2006, pp. 2123-2136.
EP Search Report and Written Opinion for EP 18186654, dated Dec. 10, 2018.

* cited by examiner

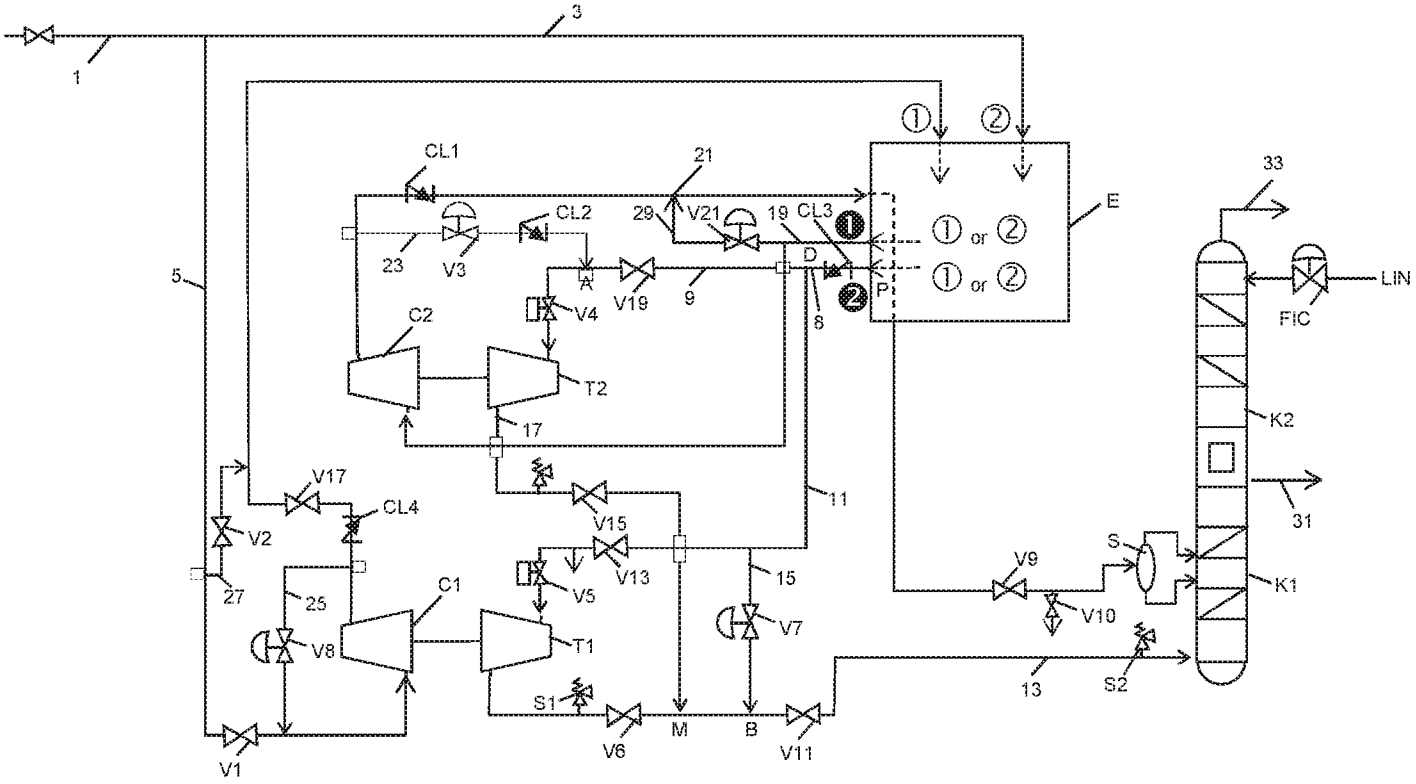
LIN
FIC
33
K2
31
K1
S
S2
E
V10
V9
13
1 or 2
1 or 2
1
2
P
CL3
19
D
8
11
15
V7
V11
B
M
V6
21
V21
29
9
V19
V15
V13
V5
T1
S1
CL2
V4
T2
17
CL1
V3
23
C2
C1
CL4
V17
25
V8
V2
27
V1
5
3
1

METHOD AND DEVICE FOR SEPARATING AIR BY CRYOGENIC DISTILLATION

CROSS REFERENCE TO RELATED APPLICATIONS

This application claims the benefit of priority under 35 U.S.C. § 119 (a) and (b) to French patent application No. FR1757493, filed Aug. 3, 2017, French patent application No. FR1757495, filed Aug. 3, 2017, French patent application No. FR1757497, filed Aug. 3, 2017, and French patent application No. FR1757498, filed Aug. 3, 2017, the entire contents of which are incorporated herein by reference.

FIELD OF THE INVENTION

The present invention relates to a method and to a device for separating air by cryogenic distillation.

The invention relates to a device for separating air by cryogenic distillation, in particular to a device using a heat exchanger to cool all the air that is intended for distillation. The device is kept cold at least partly by one or two turbines, at least one of which is coupled to a compressor. An air compressor has an inlet temperature that is an intermediate temperature of the heat exchanger, below 0° C., even below −50° C. It receives air from an intermediate level of the heat exchanger. Another air compressor can have an inlet temperature above 0° C.

BACKGROUND

The use of such a compressor with an inlet temperature below 0° C., which is known as a "cold compressor" since it has a very cold inlet temperature, raises problems. Upon start-up, the air heated in the cold compressor can be at a temperature that is greater than the temperatures supported by the heat exchanger.

It is known from FR-A-2851330, which discloses a method according to the preamble of claim 1, for the outlet of a cold compressor to be connected to the inlet of a turbine via parallel ducts, one of which passes through the main heat exchanger of the air separation device and the other one of which does not pass through the heat exchanger. Thus, upon start-up of the machines, it is recommended that the air compressed in the cold compressor is sent to the turbine without passing through the heat exchanger, in order to avoid sending excessively hot air thereto. In this method, there is a risk of the hot air from the compressor 5 passing via the valve V1 towards the exchanger, which can damage the exchanger.

It is known for at least part of the frigories required for air separation to be supplied by expanding air in one turbine or two turbines connected in parallel, which turbine(s) is/are fed with air originating from a compressor or a suppressor.

The expanded air is sent to a medium pressure column of a double distillation column and is separated in order to form at least one oxygen or nitrogen enriched product.

SUMMARY OF THE INVENTION

Certain embodiments of the present invention can allow the installation cost to be reduced, restarting to be facilitated and the pressures required for the installation to be computed.

A check valve, also called non-return valve, is a valve that allows the fluids to flow downstream, but which closes automatically in order to block any fluid that would return upstream.

Within the context of a device comprising a cold suppressor of air taken at an intermediate level of the heat exchanger, the addition of an additional duct is proposed in order to periodically send at least part, and even all, of the air from the cold suppressor to the inlet of at least one air expansion turbine, without passing through the exchanger.

In this case, the pressure that is to be supported by the heat exchanger needs to be defined as a function of the balancing pressure of the valve at the outlet of the cold suppressor sending air to the turbine. This pressure is greater than the turbine inlet pressure for a device without this additional duct. This can require a change of waves and thus an additional cost for the exchanger.

In order to reduce the cost of the exchanger, the invention proposes disposing a check valve on the duct feeding the two turbines with air originating from an intermediate point of the main heat exchanger. This valve is disposed so that the air arriving from the cold suppressor from the additional duct is prevented from entering the heat exchanger. The valve closes automatically to prevent the air from flowing towards the exchanger. In normal operation, it leaves the air to flow from the exchanger towards the one or more expansion turbine(s).

According to one aim of the invention, a method is provided for separating air by cryogenic distillation, wherein:

i) compressed and purified air is cooled in a heat exchanger, a first part of the air is compressed in a compressor at an intermediate temperature of the heat exchanger and is sent to the heat exchanger, where it cools, the first part of the air is in a liquefied state and is returned to at least one first column of a double column, the double column comprising the first column and a second column, the second column operating at a lower pressure than the first column;

ii) oxygen and nitrogen enriched liquids are sent from the first column to the second column, an oxygen enriched fluid is extracted from the bottom of the second column and a nitrogen enriched fluid is extracted from the top of the second column and is heated in the heat exchanger;

iii) a second part of the air exits the heat exchanger at an intermediate temperature thereof and optionally is subsequently divided into a first and a second fraction at a division point, the second part of the air, or at least part of the first fraction, is allowed to expand in a first turbine and is sent to the first column, optionally at least part of the second fraction is allowed to expand in a second turbine and is sent to the first column; and iv) the discharge of the compressor is connected to the inlet of the turbine or of at least one of the first and second turbines through a duct and an arrival point, which allows air to be sent from the compressor to the turbine or to one of the turbines, without passing through the heat exchanger, characterised in that the second part of the air is sent to a check valve downstream of the heat exchanger and optionally upstream of the division point in the case of two turbines, the valve being used to prevent the air from moving in the opposite direction to that of normal operation and from arriving in the exchanger from the arrival point and being disposed on a duct between the arrival point and the exchanger.

The terms "downstream" and "upstream" in this claim refer to the direction of flow of the air during normal operation of the method.

According to other optional aspects:

during start-up, air is sent from the compressor to the turbine or to one of the turbines by passing through the arrival point, but without passing through the heat exchanger, the air being discharged by the check valve;

the at least one part of the second fraction is allowed to expand in the second turbine (T2) and is sent to the first column, the at least one part of the first fraction allowed to expand in the first turbine and the at least one part of the second fraction allowed to expand in the second turbine are mixed at a mixing point and are subsequently sent to the first column as a single flow;

part of the first and/or the second fraction is not allowed to expand in a turbine but in a valve and is subsequently sent to the system of columns;

during start-up and/or during reduced flow operation in the column and/or during depressurisation, part of the first and/or of the second fraction is not allowed to expand in a turbine but in a valve and is subsequently sent to the system of columns;

part of the second part of the air is not allowed to expand in the turbine but in a valve and is subsequently sent to the system of columns;

during start-up and/or during reduced flow operation in the column and/or during depressurisation, part of the second part of the air is not allowed to expand in the turbine but in a valve and is subsequently sent to the system of columns;

part of the first and/or the second fraction allowed to expand in the valve is mixed with the single flow sent to the first column downstream of the mixing point;

air is cooled in the heat exchanger to an intermediate temperature thereof, is compressed in the compressor and is returned to the heat exchanger, the compressor being driven by the first or the second turbine;

the inlet temperature of the compressor is below 0° C., even below −50° C.

According to another aim of the invention, a device for separating air by cryogenic distillation is provided comprising a heat exchanger, a double separation column comprising a first column and a second column, the second column operating at a lower pressure than the first column, means for sending compressed and purified air to cool in the heat exchanger, a compressor, means for extracting a first part of the air at an intermediate point of the heat exchanger at an intermediate temperature and for sending the air to the compressor, means for returning air compressed in the compressor to the heat exchanger, where it cools, means for sending liquefied air to at least the first column, means for sending oxygen and nitrogen enriched liquids from the first column to the second column, means for extracting an oxygen enriched fluid from the bottom of the second column, means for extracting a nitrogen enriched fluid from the top of the second column and means for sending the nitrogen enriched fluid to be heated in the heat exchanger, an extraction duct for extracting a second part of the air from the heat exchanger at an intermediate temperature thereof and at an intermediate point of the heat exchanger, optionally means for dividing the second part into a first and a second fraction at a division point, a first turbine and optionally a second turbine, means for sending at least one part of the first fraction to expand in the first turbine and subsequently sending it to the first column, optionally means for sending at least one part of the second fraction to expand in the second turbine and subsequently sending it to the first column and means for sending air from the discharge of the compressor to an inlet of the turbine or of one of the turbines without passing through the heat exchanger, said means being connected to an arrival point (A), characterised in that it comprises a check valve disposed on the extraction duct downstream of the heat exchanger and optionally upstream of the division point, the valve being disposed on a duct between the arrival point and the exchanger and being capable of preventing air from arriving from the arrival point to the exchanger.

The terms "downstream" and "upstream" in this claim refer to the direction of flow of the air during normal operation of the device.

According to other optional aspects:

the device comprises means for mixing the at least one part of the first fraction allowed to expand in the first turbine (T2) and the at least one part of the second fraction allowed to expand in the second turbine at a mixing point and means for sending said parts to the first column as a single flow;

the device comprises an expansion valve connected to the check valve through the division point and connected to the system of columns, so that the air can pass from the valve to the system of columns without passing through a turbine;

when the device comprises two turbines, the means for sending air from the discharge of the compressor to an inlet of one of the turbines, without passing through the heat exchanger, are connected to an arrival point between the division point and the inlet of the turbine;

the device comprises the second turbine and a valve between the arrival point and the division point.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

The invention will be described in further detail with reference to the FIGURE, which shows a device for separating air by cryogenic distillation according to the invention.

DETAILED DESCRIPTION OF THE INVENTION

The device comprises a system of columns comprising a column operating at a first pressure K1 and a column operating at a second pressure K2 below the first pressure. The columns are thermally connected through a bottom reboiler of the second column heated by nitrogen from the top of the first column. Nitrogen and oxygen enriched reflux flows, not shown, are sent from the column K1 to the column K2. Liquid oxygen 31 is extracted from the bottom of the second column K2 and gaseous nitrogen 33 is extracted from the top of the second column. Liquid nitrogen is sent from the top of the second column in certain phases in order to help to keep the method cold. Liquid oxygen 31 can vaporise in the heat exchanger E.

The device comprises a first air expansion turbine T1, a second air expansion turbine T2, a first air compressor C1 coupled to the first turbine and a second air compressor C2 coupled to the second turbine. Compressed air 1 at a pressure P and originating from another compressor (not shown) is divided into two portions, a first portion 3 of which is sent to the heat exchanger E without having been compressed at a pressure above the pressure P. A second portion 5 is sent to the first compressor C1, where it is compressed at a pressure above the pressure (P) of the first portion 3. The outlet of the first compressor C1 is connected to the inlet of this compressor by a duct 25 through a valve V8.

The inlet temperature of the compressor C2 is below 0° C., even below −50° C. According to a first variation, the first portion 3 is cooled in the heat exchanger E to an intermediate temperature thereof and at an intermediate point P of the exchanger and, having not been compressed in the first compressor, is sent to the first and the second turbines through the open valve CL3 and the open valves V5, V13, V4, V19, with the air being divided into two at a division point D in order to be sent to the two turbines T1, T2.

The second portion 5 cools in the heat exchanger E to an intermediate temperature thereof, after having been compressed in the first compressor C1. It is subsequently sent to the second compressor C2.

During normal operation, expanded air originating from the first and second turbines is sent to the first column K1 in order to be separated through the valves V6, V15, V11 and the duct 13. The second portion 5 is compressed in the second compressor C2, passes through the open valve CL1 and is subsequently cooled in the heat exchanger before being sent in liquid form to the first column K1 through the valve V9. The valves V2 and V3 are closed.

In the start-up phase, there is some concern that the air originating from the compressor C2 is too hot when it reaches the inlet of the exchanger E at the outlet of C2, for example, at a temperature above the 65° C. mechanical resistance temperature of the exchanger. In order to avoid this, the valve V9 is closed and the valve V3 is opened.

Thus, the air originating from the compressor C2 no longer passes towards the heat exchanger E but passes towards the inlet of the second turbine T2, through the duct 23 and the open valve V3. All the air cannot pass through the turbine, therefore the valve V4 is open, the flow passing through the turbine being limited by the opening of the blades of the turbine and the remainder of the air originating from the compressor C2 passes to the column through the ducts 11 and 15.

It is also possible for the start-up air to be sent to the inlet of the two turbines. Thus, the air passes through the duct 11 and passes to the turbine T1 through the valves V13, V5 and/or to the short-circuiting duct 15, in which it is allowed to expand by the valve V7 in order to obtain a pressure reduction similar to that of the turbine T1. The valve V2 remains closed. It is also possible to send the air originating from the compressor C2 to the discharge of the turbine T1 and/or to the discharge of the turbine T2. Thus, the air circulates neither in the heat exchanger nor preferably in the turbines and passes directly to the distillation column. The valve CL3 prevents the air 23 from moving in the opposite direction to that of normal operation and from arriving in the exchanger at the intermediate point P. The air sent to the turbine through the duct 23 during start-up reaches an arrival point A upstream of the turbines T1, T2, preferably downstream of the division point D, but downstream of the heat exchanger E and of the check valve CL3.

The valve is disposed on the extraction duct 8, preferably between the extraction point P for air intended for the turbines and the division point D of the fractions 9 and 11 where the air is shared between the two turbines. This division point also can be used to divide the air intended for the short-circuiting duct.

The valve must be located between the arrival point A for the air originating from the duct 23 and the intermediate point P of the exchanger E.

In a less efficient version, the valve can be placed on the duct 9 if the duct 23 emerges in the duct 9 or on the duct 11 if the duct 23 emerges on the duct 11.

When the turbines T1, T2, and therefore the compressors C1, C2, are started, the anti-pumping valves of the compressors C1, C2 are fully open (valve V8 for C1 and valve V3 for C2).

This allows hot start-up of the cold compressor C2, irrespective of the temperature and without affecting the computation temperatures of the equipment downstream of the compressor C2. The temperature increase is extremely low on start-up, given the minimum compression rate on the compressor C1 by virtue of the anti-pumping valve V3.

According to a second variation, the first portion 3 is discharged from a heat exchanger at an intermediate temperature thereof and, having not been compressed in the first compressor, is sent to the second compressor C2.

The second portion 5 cools in the heat exchanger to an intermediate temperature thereof, after having been compressed in the first compressor C1, and is extracted at an intermediate point P of the exchanger by an extraction duct 8. It is subsequently sent to the first and the second turbines. In this case, it is the first portion 3 of the air that is diverted, in the case of start-up, so as to no longer pass through the heat exchanger E but to pass directly to the inlet of the turbine T1 or T2, or even to both.

As described above, it is recommended that part of the air originating from the duct 23 is sent to the duct 9 by opening the valve V19 and subsequently to the duct 11 and the short-circuiting duct 15 with its valve V7. The valve CL3 prevents this air 23 from moving in the direction opposite that of normal operation and from arriving in the exchanger at the intermediate point P. The air sent to the turbine through the duct 23 during start-up reaches an arrival point A upstream of the turbines T1, T2, preferably downstream of the division point D, but downstream of the heat exchanger E and the check valve CL3.

The valve is disposed on the extraction duct 8, preferably between the extraction point P for air intended for the turbines and the division point D of the fractions 9 and 11 where the air is shared between the two turbines. This division point also can be used to divide the air intended for the short-circuiting duct.

The valve must be located between the arrival point A for the air originating from the duct 23 and the intermediate point P of the exchanger E.

In a less efficient version, the valve can be placed on the duct 9 if the duct 23 emerges in the duct 9 or on the duct 11 if the duct 23 emerges on the duct 11.

The invention is also applicable to the case in which the device only comprises a single air turbine coupled to a cold compressor. In this case, in normal operation the air is sent from the cold compressor to the heat exchanger. The air can subsequently directly enter the column system after expansion or otherwise can be sent, at least partly, to the single turbine.

During start-up, the air from the cold compressor can avoid the heat exchanger by passing through a short-circuiting duct connected upstream of the inlet of the single turbine. The air also can be sent from this short-circuiting duct to another short-circuiting duct, which allows air to be sent from the cold compressor to the column system, without passing through the turbine, by being allowed to expand in a valve.

The air sent to the turbine through the duct 23 during start-up reaches an arrival point A upstream of the turbine but downstream of the heat exchanger E and the check valve CL3. The valve CL3 closes the extraction duct 8 and thus prevents the air originating from the duct 23 from advancing towards the exchanger.

The position of the check valve CL3 on the extraction duct 8, between the arrival point A of air from the compressor C2 and the intermediate point P of the exchanger, allows the computation pressure of the exchanger E to be reduced, which affects the cost of the device.

Without a valve CL3 on the extraction duct 8, the pressure of the exchange line E proceeding towards the suction side of the turbine or the turbines T1, T2 must be defined as a function of the balancing pressure due to the connection of the anti-pumping valve V3 from the cold booster outlet C2 to the suction side of the turbine T2 in the variation of the FIGURE. This balancing pressure is necessarily higher than the pressure of the normal source coming from the turbine. In some cases, this can require a change of waves and thus an additional cost for the exchanger.

With the valve, the design of the exchanger does not take into account the balancing pressure and only a flow valve PSV is used that is defined on the basis of the scenario of a leak in the valve CL3 placed between the outlet P of the exchanger and the valve CL3.

For the variation with two turbines, the position of the check valve CL3 upstream of the division point D dividing the ducts feeding the two turbines allows a rapid means to be provided for depressurising the suction of the turbines before restarting, if the layout (division point D) of the additional duct 11, 15 for bypassing turbines is downstream of this common valve CL3.

In the event that the valve CL3 is not on the common line 8 proceeding from the exchanger E towards the two turbines T1, T2, but is only on the line 9 feeding the single turbine T2, after each stoppage and thus for each restart, the balancing pressure would be at the inlet of this turbine (higher and even much higher than the operating pressure). Since a "cul-de-sac" condition occurs in this configuration, this pipe section cannot be depressurised by passing through the turbine but would require taking into account a case of starting up at a higher suction pressure, which has design impacts and is even technically impossible (excessively high expansion ratio) or requires the addition of a depressurisation device. In the case of the invention, where the valve is disposed on the common line feeding the two turbines, the pressure will not increase as high due to the balancing in a higher pipe volume and it will still have the remote depressurising means before restarting by the valve V7 for bypassing towards the column K1.

The position of the check valve CL3 upstream of the division point D dividing the ducts feeding the two turbines allows detrimental dimensioning to be overcome, relative to the balancing pressure of the compressor C2, for the exchange line E by slightly overgauging the pressure to be applied to the turbines T1, T2. This overgauging is negligible with respect to the extra cost that would have to be applied to the exchange line E if the valve CL3 was not present.

Within the scope of the invention, the operating pressures of the one or two turbines or of the exchanger (in the example, the turbine T2 connected to the compressor C2 and the exchange line E) can be defined without waiting for the final design of the pipework to compute and know the effective volumes to be taken into account in a conventional computation, which saves time.

The computation pressure of the exchange line E therefore is completely independent of the balancing pressure by virtue of the valve CL3 and a valve for protecting the valve CL3 against leaks, it is thus possible to define its computation pressure at the very beginning of the project, independently of the turbine T2. As the computation pressure on the turbine T2 does not significantly affect its cost, approximations can be made of the volume in order to conservatively define the balancing pressure to be taken into account on the turbine, without having the outline and the exact volume of pipework that would allow precise computation of the balancing pressure.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A method for separating air by cryogenic distillation, the method comprising a normal mode and a start-up operation, wherein the normal operation comprises the steps of:

i) cooling compressed and purified air in a heat exchanger, compressing a first part of the air in a cold compressor at an intermediate temperature of the heat exchanger and returning the first part of the air to the heat exchanger for further cooling and liquefaction within the heat exchanger to form liquid air, wherein the liquid air is sent from the heat exchanger to at least a first column of a double column, the double column comprising the first column and a second column, the second column operating at a lower pressure than the first column;

ii) sending oxygen and nitrogen enriched liquids from the first column to the second column, extracting an oxygen enriched fluid from the bottom of the second column, and extracting a nitrogen enriched fluid from the top of the second column and then heating the nitrogen enriched fluid in the heat exchanger; and iii) withdrawing a second part of the air from the heat exchanger at an intermediate temperature thereof, expanding the second part of the air in a first turbine before sending to the first column;

wherein the start-up operation comprises the step of:

iv) sending the first part of the air from the cold compressor to a short-circuiting duct and then expanding the first part of the air to form an expanded fraction of boosted air;

v) sending the expanded fraction of boosted air to the system of columns for separation within, wherein steps iv) and v) are conducted without the first part of the air or the expanded fraction of boosted air having been cooled in the main heat exchanger, wherein there is a check valve disposed downstream of the heat exchanger, the check valve being in fluid communication with the heat exchanger, the short-circuiting duct, and the inlet of the first turbine, the check valve being configured to prevent the first part of the air from moving in the opposite direction to that of normal operation and from being introduced into the heat exchanger from the short-circuiting duct.

2. The method according to claim 1, wherein in step iv) the first part of the air is sent from the cold compressor to the first turbine and/or to a second turbine by passing through the short-circuiting duct and an arrival point, thereby allowing the first part of the air to be sent from the cold compressor to the first turbine and/or to the second turbine without passing through the heat exchanger therebetween.

3. The method according to claim 1, further comprising the step of providing a second turbine, wherein the second part of the air is divided into a first fraction and a second fraction, wherein the first fraction expands in the first turbine and at least a first portion of the second fraction expands in the second turbine, wherein the first fraction and the second faction, after expanding in the first and second turbines, are mixed at a mixing point and are subsequently sent to the first column as a single flow.

4. The method according to claim 3, wherein a second portion of the second fraction is expanded in an expansion valve and then mixed with the first portion of the second fraction at a location downstream the mixing point and upstream the first column.

5. The method according to claim 1, wherein the cold compressor is driven by the first or the second turbine.

6. The method according to claim 1, wherein the inlet temperature of the cold compressor during the normal operation is below 0° C.

7. The method according to claim 1, wherein the inlet temperature of the cold compressor during the normal operation is below −50° C.

8. The method according to claim 1, wherein the method further comprises the steps of measuring an outlet temperature of the cold booster, and then in response to the measured outlet temperature of the cold booster, switching between the normal operation and the start-up operation.

9. A device for separating air by cryogenic distillation comprising:

a heat exchanger having a warm end, a cold end, and an intermediate section disposed between the warm end and the cold end;

a double separation column comprising a first column and a second column, the second column operating at a lower pressure than the first column, wherein the double separation column is in fluid communication with the cold end of the heat exchanger thereby allowing for the double separation column to receive a liquefied air from the cold end of the heat exchanger; wherein the double separation column is configured to send an oxygen-enriched liquid and a nitrogen-enriched liquid from the first column to the second column, wherein the double separation column is further configured to send an oxygen-enriched fluid from the bottom of the second column and a nitrogen-enriched fluid from the top of the second column to the cold end of the heat exchanger for warming therein;

an air feed conduit configured to send compressed and purified air to the warm end of the heat exchanger;

a cold compressor in fluid communication with the intermediate section of the heat exchanger, such that the cold compressor is configured to receive a first part of air from the intermediate section of the heat exchanger, a first conduit in fluid communication with an outlet of the cold compressor and the heat exchanger, such that the first conduit is configured to transfer compressed air from the cold compressor to the heat exchanger;

an extraction duct in fluid communication with the intermediate section of the heat exchanger, the extraction duct being configured to extract a second part of the air from the heat exchanger at an intermediate temperature;

a first turbine in fluid communication with the extraction duct, such that the first turbine is configured to receive at least a first fraction of the second part of the air from the extraction duct, wherein an outlet of the first turbine is in fluid communication with the first column;

a short-circuit conduit in fluid communication with a discharge of the cold compressor and the extraction duct, wherein the short-circuit conduit connects to the extraction duct at an arrival point, wherein the short-circuit conduit does not traverse through the heat exchanger, the short-circuit conduit having a control valve configured to allow or restrict flow of compressed air received from the cold compressor through the short-circuit conduit;

a check valve disposed on the extraction duct downstream of the heat exchanger, the check valve being disposed on the extraction duct between the arrival point and the heat exchanger and being configured to prevent air from moving from the arrival point and into the heat exchanger.

10. The device according to claim 9, further comprising a division point downstream the check valve, wherein the division point is disposed between the check valve and the arrival point.

11. The device according to claim 10, further comprising a second turbine in fluid communication with the division point, wherein the division point is configured to split the second part of the air from the heat exchanger into a first fraction and a second fraction, wherein the first turbine is configured to receive the first fraction, wherein the second turbine is configured to receive the second fraction.

12. The device according to claim 11, wherein the first fraction and the second fraction are mixed together at a mixing point following expansion in the first turbine and second turbine, respectively.

13. The device according to claim 10, further comprising an expansion bypass-valve disposed downstream the check valve through the division point and connected to the system of columns, so that air can pass from the expansion bypass-valve to the system of columns without passing through either the first turbine or the second turbine.

14. The device according to claim 10, further comprising a second turbine, wherein the arrival point is in fluid communication with the first turbine and the second turbine, such that the first turbine and the second turbine are configured to receive the compressed air from the cold compressor via when the control valve disposed in the short-circuit conduit is in an open state.

15. The device according to claim 14, further comprising a secondary flow valve disposed between the arrival point and the division point, the secondary flow valve being configured to allow flow from the arrival point through the division point and the second turbine and/or an expansion bypass-valve when the secondary flow valve is in an open state.

16. The device according to claim 9, wherein the check valve is configured to close automatically.

17. The device according to claim 9, wherein the cold compressor is driven by the first turbine or a second turbine.

18. The device according to claim 9, wherein the device is configured to operate in a start-up phase and a normal operating phase, wherein when the device is in the start-up phase, the control valve of the short-circuit conduit is in an open state, wherein when the device is in the normal operating phase, the control valve of the short-circuit conduit is in a closed state.

19. The device according to claim 18, wherein the device is further configured to switch between the start-up phase and the normal operating phase based on a measured temperature of air flowing from an outlet of the cold booster.

20. The device according to claim 18, wherein when the device is in the normal operating phase, the cold compressor is not in fluid communication with the inlet of the first turbine.

* * * * *